US007671550B2

(12) United States Patent
Wang

(10) Patent No.: US 7,671,550 B2
(45) Date of Patent: Mar. 2, 2010

(54) MOTOR CONTROL APPARATUS PROVIDING EXERCISE RESISTANCE AND AUTO-REWINDING FUNCTIONS

(76) Inventor: Leao Wang, No. 1, Lane 233, Sec. 2, charng Long Rd., Taiping (TW) 411

( * ) Notice: Subject to any disclaimer, the term of this patent is extended or adjusted under 35 U.S.C. 154(b) by 289 days.

(21) Appl. No.: 11/824,721

(22) Filed: Jul. 3, 2007

(65) Prior Publication Data

US 2009/0009110 A1 Jan. 8, 2009

(51) Int. Cl.
*H02P 1/00* (2006.01)

(52) U.S. Cl. ..... 318/261; 318/380; 482/5; 482/94

(58) Field of Classification Search ..... 318/261, 318/256, 255, 380; 482/5, 94
See application file for complete search history.

(56) References Cited

U.S. PATENT DOCUMENTS 4,423,363 A * 12/1983 Clark et al. ..... 318/375
4,927,136 A * 5/1990 Leask ..... 482/52
5,435,798 A * 7/1995 Habing et al. ..... 482/5
7,141,006 B1 * 11/2006 Chen et al. ..... 482/54
7,315,144 B2 * 1/2008 Imaie et al. ..... 318/380
7,482,767 B2 * 1/2009 Tether ..... 318/139

* cited by examiner

*Primary Examiner*—Bentsu Ro
*Assistant Examiner*—David S Luo

(57) ABSTRACT

A motor control apparatus providing an exercise resistance and an auto-rewinding function mainly employs a microprocessor to operate with a current detection feedback loop and a motor rotation speed detection loop for precisely controlling a quick random operation of a motor such that an axle of the motor can quickly control a loss braking unit and a power driving unit based on the existence of an external force, and the motor can automatically switch to an electric generator output mode (for providing an exercise resistance) or an electric machine output mode (for providing the automatic rewinding function).

4 Claims, 2 Drawing Sheets

MOTOR CONTROL APPARATUS PROVIDING EXERCISE RESISTANCE AND AUTO-REWINDING FUNCTIONS

BACKGROUND OF THE INVENTION

1. Fields of the Invention

The present invention relates to a motor control apparatus, and more particularly to a motor operating with a microprocessor for selectively executing two different output modes: an electric generator mode or a power machine mode of the motor and the motor is applied in various different fitness equipments such as a weight lifting machine and a rowing exercise machine for stretching exercises and thus simplifying the components of the fitness machine.

2. Description of the Related Art

As we all know, a traditional weight lifting machine (not shown in the figure) usually uses metal weights as the source of exercise resistance, and the weight lifting machine comes with complicated components and large volume that result in wasting spaces and generating noises. Therefore, manufacturers try to replace the metal weights or flywheels with a motor operated in an electric machine output mode and provide an exercise resistance to various different fitness equipments such as the fitness machines with a design of an electric motor as disclosed in U.S. Pat. Nos. 6,790,163, 5,762,584 and 5,435,798, so as to provide the expected exercise resistance. Thereafter, a built-in program of a microprocessor is operated together with the motion of a force measuring device for the clockwise and counterclockwise rotations of a motor of the electric machine in order to provide a resistance and rewinding function as disclosed in R.O.C. Pat. No. I268789 entitled "Programmable control resistance apparatus and method used for fitness equipment".

Although R.O.C. Pat. No. I268789 can achieve the expected effect, any person with ordinary skill in the electric field knows about that when the axle of an electric machine is braked in a reverse direction, the electric machine will have a "plugging" phenomenon. In other words, the electric machine will produce several generated current feedbacks to the overall circuit system, such that if the generated current is not eliminated properly, then the life expectancy of the motor and the overall circuit system will be affected adversely.

Further, the aforementioned patent uses a force measuring device to measure the data of a force exerted onto a rope, and the detected data is compared with a predetermined value of the microprocessor to control the clockwise and counterclockwise rotation of the motor, or even provide an appropriate safety response based on the existence of an abnormal force exerted onto the rope. In fact, the force measuring device usually has to go through a "stable" process each time when a user sets the unit measuring time (which is similar to a fluctuation of the readings at an early stage of a measurement occurred when we stand on a scale to measure our body weight), and thus we can obtain the best measured reading, but such arrangement greatly slows down the response of the overall circuit system. Simply speaking, the conventional resistance control apparatus is unable to cope with the natural response speed of a general exerciser's brain and limbs, unless the exerciser is operating and exercising at a very slow constant speed.

SUMMARY OF THE INVENTION

In view of the shortcomings of the prior art, the inventor of the present invention based on years of experience in the related industry to conduct extensive researches and experiments, and finally invented and developed a motor control apparatus for operating a motor at different output modes, so as to achieve the expected effect of simplifying the structure of the motor and reducing the components as well as maintaining a long life expectancy of the motor.

Therefore, it is a primary object of the invention to provide a motor control apparatus characterized in that a microprocessor is operated together with a current detection feedback loop and a motor rotation speed detection loop for precisely controlling a quick random operation of a motor, such that the motor axle can control a loss braking unit and a power driving unit based on the existence of an external force, and the motor can be switched automatically to an electric generator output mode or an electric machine output mode.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Firstly, it is noteworthy to point out that the so-called "electric generator output mode" of a motor refers to an output mode that converts mechanical energy (external force) into electric energy, and the so-called "electric machine output mode" of the motor refers to another output mode that converts electric energy into mechanical energy. A motor can selectively carry out two different output modes through different circuit layouts, and it relates to the basic principle of electromagnetic induction, and the present invention is a novel control apparatus with a design based on such natural law and applied in various different fitness equipments for stretching exercises such as a weight lifting machine and a rowing machine.

Figure 1:
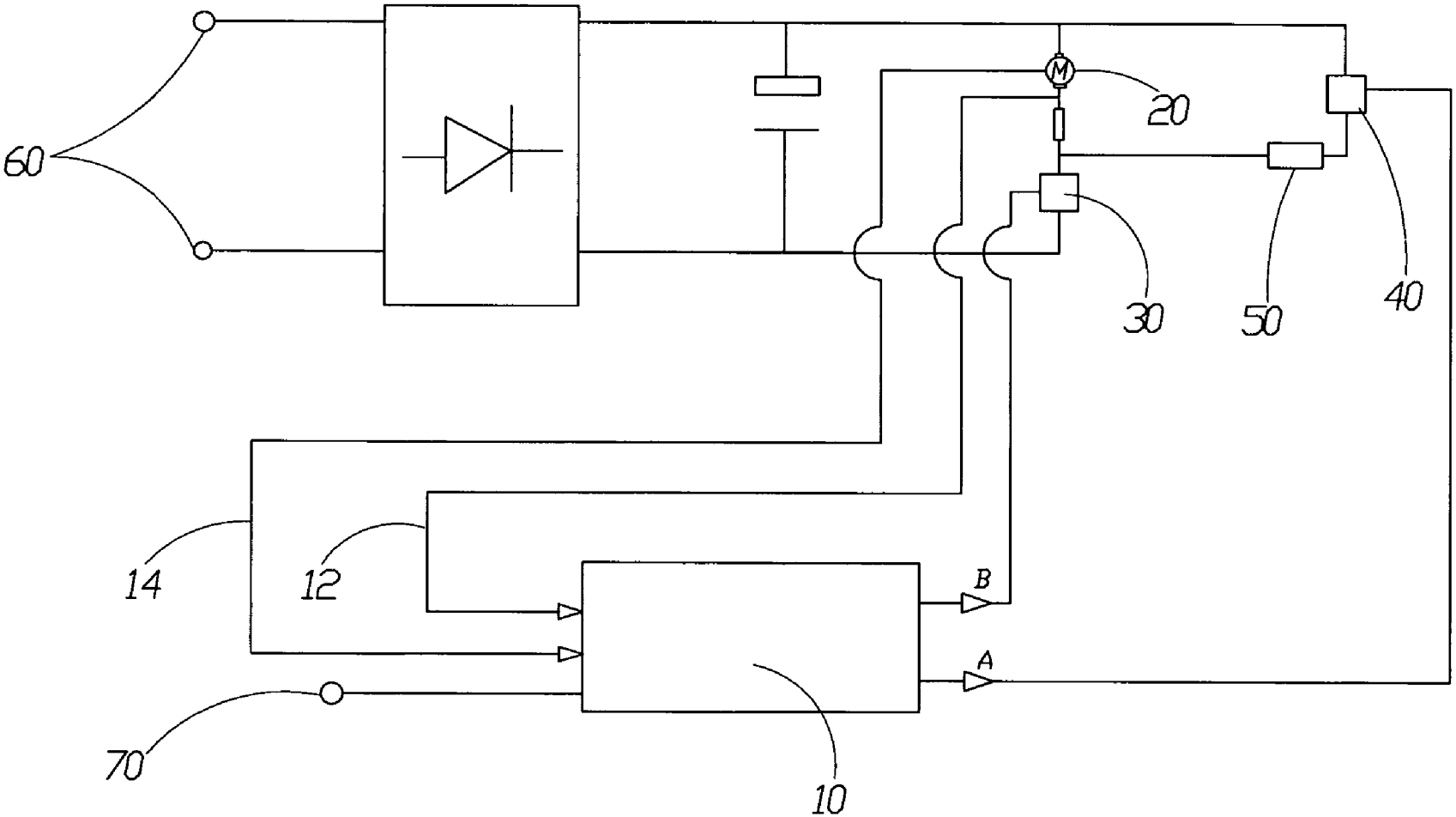
FIG. 1 is a schematic view of a basic circuit layout in accordance with a preferred embodiment of the present invention.
Figure 2:
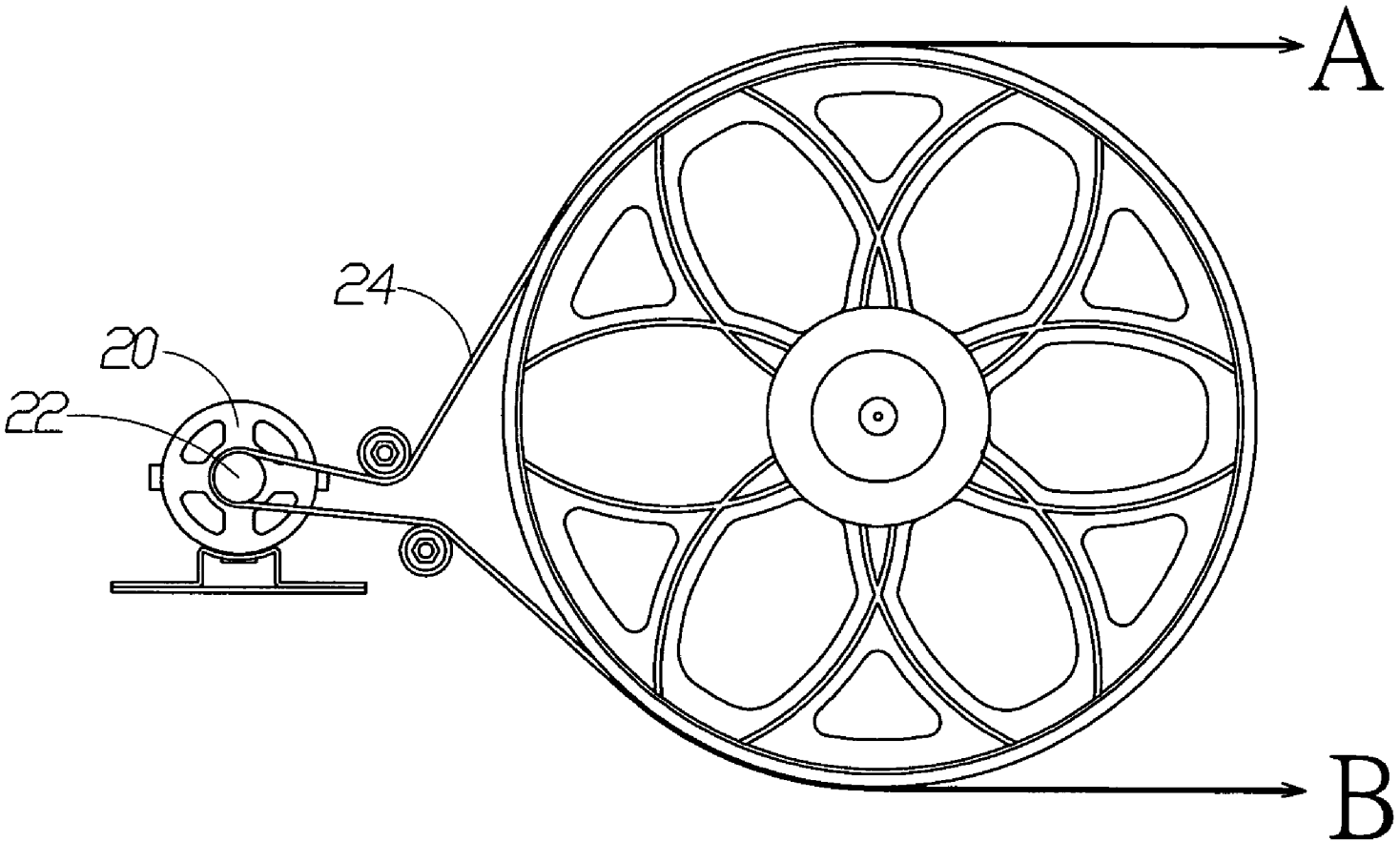
FIG. 2 is a schematic view of the rotating direction of a motor axle in accordance with a preferred embodiment of the present invention.

Referring to FIGS. 1 and 2 for a preferred embodiment of the present invention, a microprocessor 10 is operated together with a current detection feedback loop 12 and a motor rotation speed detection loop 14 for precisely controlling the quick random operation of a motor 20, such that an axle 22 of the motor 20 can quickly control a loss braking unit 40 and a power driving unit 30 based on the existence of an external force, and the motor can automatically switch to an electric generator output mode (for providing an exercise resistance) or an electric machine output mode (for providing the automatic rewinding function).

The process of operating and controlling the motor 20 is described as follows: For the electric generator output mode, when the axle 22 of the motor 20 is exerted by a force and rotated towards a stretching direction A (which is equivalent to a user pulling a transmission belt 24), the microprocessor 10 commands a power driving unit 30 to stop the operation through an announcement of the current detection feedback loop 12, and a loss braking unit 40 is electrically conducted, and then a load resistance 50 consumes and eliminates the energy produced in the electric generating mode.

For the electric machine output mode, when the axle 22 of the motor 20 is paused or stopped (which is equivalent to a user stopping applying a force to release the transmission belt 24), the microprocessor 10 commands the power driving unit 30 to be electrically conducted, and supplies electric energy from a power supply end 60 to start winding in the winding direction B, and the loss braking unit 40 stops the operation synchronously through the same current detection feedback loop 12.

Regardless of the electric generator output mode or the electric machine output mode of the motor 20, the current detection feedback loop 12 monitors the current values of both power driving unit 30 and loss braking unit 40 all the time, so that the operating procedure of the actual application requires a user to set a desired exercise weight or resistance (hereinafter referred to as "Current Output Setting") from a parameter setting end 70. Before an external stretching force acts on the axle 22 of the motor 20, the motor 20 is in the electric machine output mode, and the output torque is equal to the aforementioned current output setting. If the axle 22 of the motor 20 is pulled in an opposite direction by an external force, the current detection feedback loop 12 will detect the occurrence of the generated current and will immediately return a message to the microprocessor 10, so that the motor 20 will quickly switch to the electric generator output mode. If the external force is paused or released, the generated current will disappear, and thus the motor 20 will switch to the electric machine output mode. This repeated operation can actually simulate the expected effect similar to the natural gravitational force of the metal weights or the winding motions.

Further, the generated electric energy of the motor 20 or the torque of the rewinding are set from the parameter setting end 70 in advance, so that the microprocessor 10 can make an appropriate control (for controlling the magnitude of current) according to the predetermined settings, but the basic operating and control method of a motor is a prior art and will not be described here.

The load resistance 50 eliminates the generated electric energy mainly by converting the electric energy into heat energy which is consumed or dissipated. Of course, the invention also can build a conducting path (not shown in the figure) to conduct and eliminate the electric energy appropriately, so as to prevent the occurrence of the "plugging" phenomenon.

The motor rotation speed detection loop 14 is provided for monitoring the rotation speed of the axle 22 of the motor 20 all the time, and computing the inertia of the axle 22 and the gravitational acceleration, and thus the motor rotation speed detection loop 14 can detect the user's exercise conditions during the whole course of exercise, and the microprocessor 10 can adjust and control the current output settings of the loss braking unit 40 and the power driving unit 30 quickly to match the user's expected weight setting for the whole course of exercise. In other words, the whole course of exercise can be monitored and controlled to simulate the natural exercise conditions, such that a user can achieve the isokinetic muscular training effect. Once if the motor rotation speed detection loop 14 detects an abnormal condition of the axle 22 of the motor 20, an appropriate safety response (such as stopping the operation of the overall circuit or retarding the rotation speed of the motor 20) will be performed according to the built-in program of the microprocessor 10.

The microprocessor 10 operates according to the settings of the built-in software program, which is a prior art and thus will not be described here.

After the current output setting is completed, the motor 20 immediately supplies the corresponding current output in the electric machine output mode. In other words, before the present invention is used, a natural gravitational force similar to the metal weights is applied to a transmission belt 24. Obviously, the design of the present invention is close to the actual exercise conditions.

After the current output setting is completed, the built-in timer (not shown in the figure) of microprocessor 10 sets the current output time of the motor 20. In other words, if the transmission belt 24 is not pulled within the set time, the power will be disconnected timely to protect the motor 20.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A motor control apparatus for providing an exercise resistance and an automatic rewinding function, characterized in that a microprocessor is operated together with a current detection feedback loop and a motor rotation speed detection loop for precisely controlling a quick random operation of a motor, such that the motor axle can control a loss braking unit and a power driving unit based on the existence of an external force, and the motor can be switched automatically to an electric generator output mode or an electric machine output mode, wherein the operating control procedure includes an electric generator output mode and an electric machine output mode; for the electric generator output mode, when an external force is exerted onto the motor axle to rotate the motor axle towards a stretching direction, the microprocessor commands the power driving unit to stop operating through an announcement of the current detection feedback loop, and loss braking unit is electrically conducted, and the load resistance eliminates the loss of energy produced in the electric generating mode; and for the electric machine output mode, when the external force of the motor axle is paused or released, the microprocessor commands the power driving unit to be electrically conducted through the same current detection feedback loop, and a power supply end supplies electric energy to start producing a reverse winding motion, and the loss braking unit stops operating synchronously.

2. The motor control apparatus for providing an exercise resistance and an automatic rewinding function as recited in claim 1, wherein the motor is in the electric machine output mode before an external stretching force acts on the axle of the motor.

3. A motor control apparatus for providing an exercise resistance and an automatic rewinding function, characterized in that a microprocessor is operated together with a current detection feedback loop and a motor rotation speed detection loop for precisely controlling a quick random operation of a motor, such that the motor axle can control a loss braking unit and a power driving unit based on the existence of an external force, and the motor can be switched automatically to an electric generator output mode or an electric machine output mode, wherein the motor rotation speed detection loop is provided for monitoring the rotation speed of the axle of the motor all the time, and computing the inertia of the axle and the gravitational acceleration, and thus the motor rotation speed detection loop can detect the user's exercise conditions during the whole course of exercise, and the microprocessor can adjust and control the current output settings of the loss braking unit and the power driving unit quickly to match the user's expected weight setting for the whole course of exercise.

4. A motor control apparatus for providing an exercise resistance and an automatic rewinding function, characterized in that a microprocessor is operated together with a current detection feedback loop and a motor rotation speed detection loop for precisely controlling a quick random operation of a motor, such that the motor axle can control a loss braking unit and a power driving unit based on the existence of an external force, and the motor can be switched automatically to an electric generator output mode or an electric machine output mode, wherein once if the motor rotation speed detection loop detects an abnormal condition of the axle of the motor, an appropriate safety response will be performed according to the built-in program of the microprocessor.

* * * * *